United States Patent [19]

Dickson

[11] 4,248,120

[45] Feb. 3, 1981

[54] STRINGED MUSICAL INSTRUMENT WITH ELECTRICAL FEEDBACK

[76] Inventor: Stewart Dickson, R.D. 2 Box 409, Hockessin, Del. 19707

[21] Appl. No.: 43,343

[22] Filed: May 29, 1979

[51] Int. Cl.[3] ..... G10H 3/00

[52] U.S. Cl. ..... 84/1.16; 333/141; 179/1 J; 84/1.05

[58] Field of Search ..... 84/1.16, DIG. 26, 1.05; 333/141; 179/1 J

[56] References Cited

U.S. PATENT DOCUMENTS

| | | | |
|---|---|---|---|
| 2,600,870 | 6/1952 | Hathaway | 84/1.16 X |
| 3,327,252 | 6/1967 | Hare | 333/141 |
| 3,435,920 | 7/1969 | Scherer | 84/1.16 |
| 3,742,113 | 6/1973 | Cohen | 84/1.15 |
| 3,813,473 | 5/1974 | Terymenko | 84/1.16 |
| 3,878,472 | 4/1975 | Osakabe | 84/DIG. 26 |
| 4,075,921 | 2/1978 | Heet | 84/1.16 |

OTHER PUBLICATIONS

Hahn, Reverberation in Audio Reproduction, Electronics World, Apr., 1962.

*Primary Examiner*—Gene Z. Rubinson
*Assistant Examiner*—Forester W. Isen

[57] ABSTRACT

A stringed instrument with feedback is formed from a string of 30 to 100 feet in length stretched taught and having pickup and driving transducers located at respective opposite ends of the string. An electronic processing system receives a signal from the pickup transducer and feeds it to the driving transducer. Each transducer comprises a pair of transducers oriented at right angles to each other and to the string, thus allowing for two independent signal channels to exist in the system.

1 Claim, 1 Drawing Figure

STRINGED MUSICAL INSTRUMENT WITH ELECTRICAL FEEDBACK

BACKGROUND OF THE INVENTION

1. Field of the Invention

The invention relates to the field of stringed instruments which employ electrical feedback.

2. Description of Prior Art

Recent times have seen the development of a number of devices for sustaining, enhancing and changing the sounds of stringed instruments. A number of these instruments accomplish sustain by the use of an electrical means of feeding the vibrations of a string on the instrument back to the string. Some also use electrical filters in the feedback loop to manipulate the harmonic character of the string and in this way change the musical timbre of the instrument. Still another kind of device can select whether the electrical signal from a string pickup transducer is the result of vibrations on the string in a vertical or in a horizontal plane.

The present invention introduces a novel configuration for a string, transducers and feedback electronics. It is the intent of this invention to make use of the feedback techniques just presented as well as properties of vibrating strings never before utilized for musical purposes, namely travelling waves along the string and rotational vibrations about the axis of the string.

SUMMARY OF THE INVENTION

A musical instrument is disclosed which is comprised of a very long string such that its fundamental period of vibration is on the order of one second. The string is secured at one end by a peg on a stationary frame which comprises one half of the instrument. The string passes over a support which is an integral part of the driving transducer assembly and which is also anchored on the stationary frame.

The string extends a distance comprising its freely vibrating length to a second support which is an integral part of the pickup transducer assembly and which is anchored on a second stationary frame which comprises the second half of the instrument. Mounted on the second frame is a second peg around which the string is wound and which can be rotated to generate tension in the string.

The pickup and driving transducers are electrically connected to various pieces of electronic equipment which form the feedback loop, mix externally generated signals into the feedback loop, control the harmonic content of the feedback signal and deliver an output signal which is ultimately heard through a loudspeaker.

DETAILED DESCRIPTION OF THE INVENTION

Figure 1:
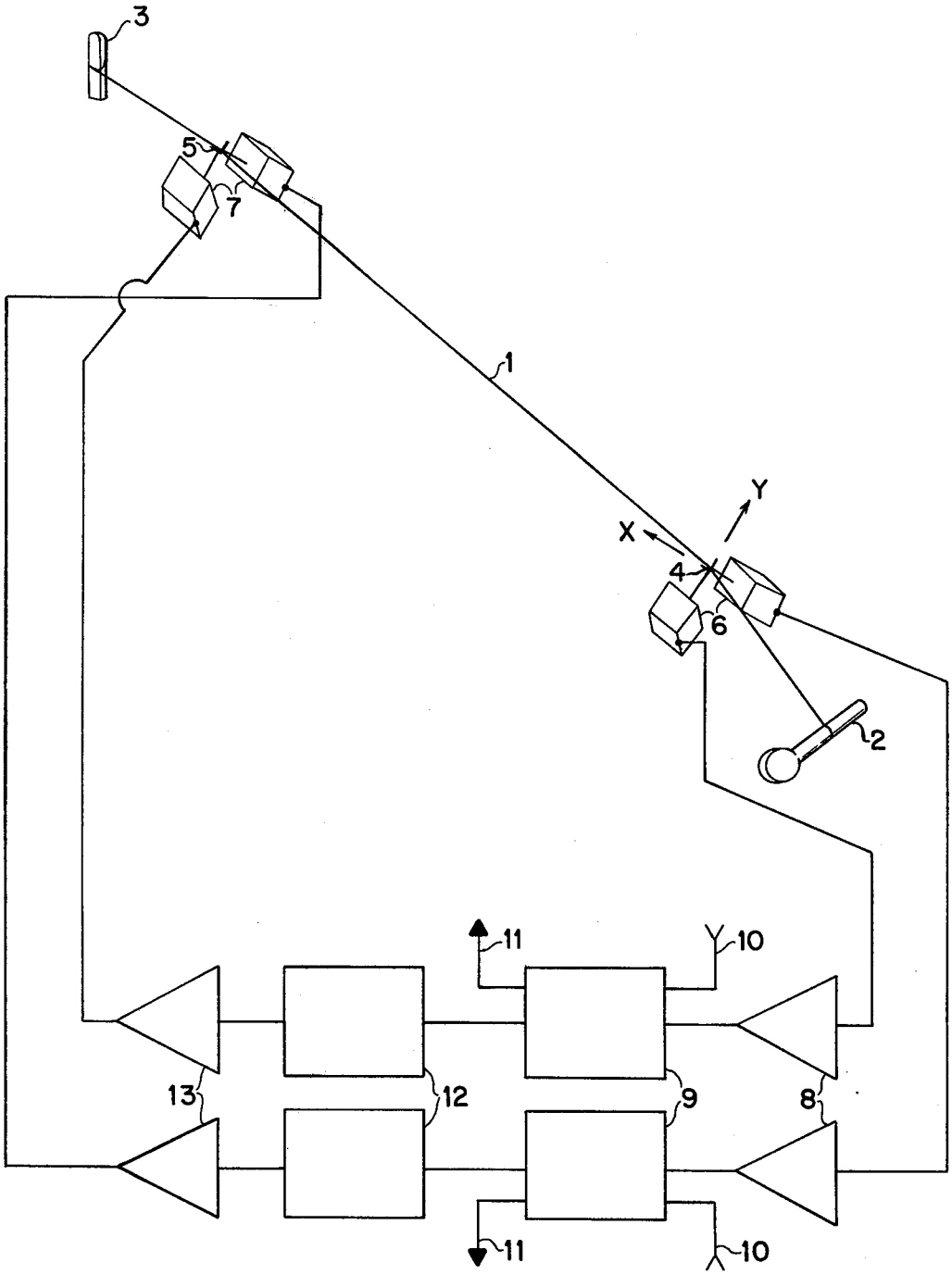

FIG. 1 illustrates the general configuration of the instrument in which the string 1 is held taught between a tuning peg 2 and a stationary peg 3. Between these two anchors the string is supported by points of contact 4 and 5 with the pickup transducer assembly 6 and driving transducer assembly 7, respectively.

The transducer assemblies are each comprised of a pair of transducers. The two transducers in each assembly are oriented so that they translate energy between the string and themselves in directions designated x and y mutually orthogonal to each other and to the axis of the string. The two transducer assemblies are in turn oriented in such a way that the said directions of energy translation lie in two orthogonal planes which intersect along the axis of the string.

The preferred embodiment of the invention is a configuration in which the tuning peg 2 and the pickup transducer assembly 6 are mounted on a single frame. The stationary peg 3 and driving transducer assembly 7 are likewise mounted on a similar frame at a distance corresponding to the string's freely vibrating length. The string is to be of a nature such that the combination of its longitudinal density, stiffness, thinness and its freely vibrating length between the transducer assemblies give it a fundmentamental period of vibration on the order of one-fifth to one second or more, as well as a capability for sustaining higher-order harmonics. In practice, a string of thirty to one hundred feet or more in length will be satisfactory.

Electrically connected to the transducer assemblies are the devices capable of both initiating and sustaining feedback on the string. The series of electronic devices is duplicated for supporting feedback in each of two channels, corresponding to each of the two orthogonal directions of transducer energy transfer and consequent planes of transverse vibration of the string as described above.

The first stage of electronic devices consists of preamplifiers 8. The mixers 9 each receive an input signal 10 from an external source, such as an electric guitar for example, which is mixed with the preamplified signal with control over the volume of each. The mixers also each supply an output signal 11 which can be further amplified and heard through spaced-apart, stereophonic loudspeakers. The equalizers 12 give control over the harmonic timbre of the feedback signal. Power amplifiers 13 supply sufficient energy to the driving transducers to sustain feedback on the string.

The electronic devices described above are all standard equipment well known to the audio engineer. The devices cited are the ones required to sustain feedback. The possibilities for additional devices which can be used are unlimited. The choice is governed by the degree and manner of control over the string's vibration which is desired.

The string can be seen to carry a two-channel feedback signal down its length. The channels can operate independently in the case of vibrations in each of the orthogonal transverse modes. When both channels operate together, they are coupled through the nonlinearity of the string in complex, three-dimensional vibration.

The aural effect heard through spaced-apart, stereophonic loudspeakers, each carrying one channel of the mixer outputs 11, is one of stereophonic spatial modulation which is a result of the changing amplitude and phase relationship between the two channels. The travelling waves along the very long string can be heard as an echo or reverberative effect as the attack of a note is sent down the string and fed back.

The overall effect of the instrument is to give the same sort of feedback effect which can be achieved by other instruments of its type, with added complexity given by the extended string length and the utilization of complex, three-dimensional vibrations.

The invention I claim is:

1. A single string in the configuration of a harmonically resonant delay line which can be manipulated as an acoustically active musical instrument and set into vibration without the necessity of an external signal, in which the string is of length thirty to one hundred feet or more, held taught between a tuning peg and a stationary peg, supported at one end by a pickup transducer assembly and at the other end by a driving transducer assembly;

having electrical connections from said pickup transducer assembly to a means for producing echo or sustain effects on the string comprising a series of electronic signal-processing devices and possible external signal source comprising at least:

a preamplifier which increases the signal from said pickup transducer assembly to a level which can be processed by subsequent electronic devices;

a mixer which;

receives the signal from said preamplifier and the signal from an external source, mixes the signal from said preamplifier with said signal from said external source, delivers a first output signal which can be amplified and heard through a loudspeaker, delivers a second output signal which functions as a feedback signal, controls the volume of the signal from said preamplifier, from said external source, and said first and second output signals;

an equalizer which electrically filters and thereby controls the harmonic content of said feedback signal;

a power amplifier which receives a filtered feedback signal from the equalizer, amplifies said filtered signal, and feeds it to the said driving transducer assembly;

in which a preferred embodiment is one in which the said stationary peg and said driving transducer assembly are mounted on a single frame and the pickup transducer assembly and tuning peg are mounted on a second similar frame a large distance, corresponding to the freely vibrating string length of thirty to one hundred feet or more, away from the first said frame;

in which a novel improvement on said instrument of a delay-line nature is one in which the driving transducer assembly and pickup transducer assembly each comprise a pair of driving transducers and pickup transducers, respectively, oriented in such a way as to translate energy to and from the string in directions lying in two orthogonal planes intersecting along the axis of the string, resulting in transverse modes of vibration in each of the said orthogonal planes, resulting further in a propogation of acoustic information along the string which can be recognized as existing in two distinct channels corresponding to each of the said orthogonal planes, each channel being driven by one of said pair of driving transducers and being picked up by a corresponding one of said pickup transducers;

in which the series of electronic signal-processing devices as described is duplicated for each channel corresponding to each said direction of energy translation.

* * * * *